US006840382B2

(12) United States Patent
Watters et al.

(10) Patent No.: US 6,840,382 B2
(45) Date of Patent: Jan. 11, 2005

(54) INTEGRALLY FORMED HEAVY MEDIA PULPING COLUMN

(75) Inventors: Larry A. Watters, Washington County, PA (US); Daniel S. Placha, Allegheny County, PA (US)

(73) Assignee: Sedgman, LLC, Pittsburgh, PA (US)

( * ) Notice: Subject to any disclaimer, the term of this patent is extended or adjusted under 35 U.S.C. 154(b) by 195 days.

(21) Appl. No.: 10/095,638

(22) Filed: Mar. 12, 2002

(65) Prior Publication Data

US 2003/0197079 A1 Oct. 23, 2003

(51) Int. Cl.[7] ..... B03B 1/00
(52) U.S. Cl. ..... 209/10; 209/317
(58) Field of Search ..... 209/3, 5, 10, 246, 209/249, 250, 317, 310; 299/10

(56) References Cited

U.S. PATENT DOCUMENTS

| | | | | |
|---|---|---|---|---|
| 2,623,637 A | | 12/1952 | Fontein | |
| 2,932,395 A | * | 4/1960 | Marot | 209/172.5 |
| 3,247,961 A | * | 4/1966 | Chase et al. | 209/1 |
| 3,541,593 A | * | 11/1970 | Weston | 209/726 |
| 3,737,032 A | * | 6/1973 | Burkitt | 209/10 |
| 4,028,228 A | * | 6/1977 | Ferris et al. | 209/39 |
| 4,164,467 A | * | 8/1979 | Liller | 209/10 |
| 5,522,510 A | * | 6/1996 | Luttrell et al. | 209/170 |
| 5,794,791 A | * | 8/1998 | Kindig | 209/727 |
| 6,269,952 B1 | * | 8/2001 | Watt et al. | 209/3 |
| 6,607,248 B1 | * | 8/2003 | Childress | 299/10 |

FOREIGN PATENT DOCUMENTS

DE 3109319 A1 * 9/1982 ..... B07B/1/28

* cited by examiner

*Primary Examiner*—Donald P. Walsh
*Assistant Examiner*—Joseph Rodriguez
(74) *Attorney, Agent, or Firm*—Buchanan Ingersoll, P.C.

(57) ABSTRACT

In a coal preparation plant which receives a raw coal feed and separates the raw coal feed into a clean coal feed and a refuse feed, an apparatus is provided for use therein. The apparatus mixes the sized raw coal feed particles with a slurry of media and water used for separating the raw coal feed into clean coal and refuse. The inventive apparatus includes a pulping column integrally designed with the discharge chute of a deslime screen and the drain section underpan of clean coal and refuse screens. The pulping column having a coal inlet receiving the sized raw coal directly from the deslime screen, a media inlet receiving the slurry of media and water directly from an underpan of at least one of the refuse screen and the clean coal screen, and an outlet discharging the mixture of sized raw coal and slurry. The pulping column mixes the sized raw coal and the slurry of media and water according to a select proportion, and it is then pumped to a heavy media separation section of the coal preparation plant.

20 Claims, 3 Drawing Sheets

INTEGRALLY FORMED HEAVY MEDIA PULPING COLUMN

FIELD OF THE INVENTION

The present invention is directed generally toward coal preparation plants and, more particularly, toward an improved integrally formed heavy media pulping column for mixing raw coal particles with a slurry of media and water.

BACKGROUND OF THE INVENTION

Coal preparation plants separate organic and non-organic solid particles by their specific gravities. The coal preparation plant receives a feed of raw mined coal, and separates the raw mined coal into clean coal and refuse. These plants typically utilize two basic processing methods for separating raw coal from rock and varying proportions of striated rock and coal from the higher quality coal. The two processing methods include heavy media and water based separation methods. Heavy media, utilizing a slurry of media, e.g., water and magnetite or ferrosilicon, to separate the coal from the refuse according to their specific gravity of dry solids, is the most common separation process for larger size (Plus 1 mm–0.5 mm) particles. Whereas, water based separation processes are more commonly used for the "cleaning" of the finer sized particles, as that term is commonly understood in the coal processing art. One type of heavy media circuitry used in the coal preparation plants includes a heavy media cyclone.

Coal preparation plants using heavy media cyclones operate with three separate types of screens for coal processing, namely, a deslime screen, a refuse screen and a clean coal screen. A common screening assembly used in many coal preparation plants today is known as a vibratory banana screen. The deslime screen receives the raw coal feed particles and separates them into coarse and fine sized fractions. The coarse or larger sized particles discharged from the deslime screen surface are directed to the heavy media separation section of the coal preparation plant, while the finer sized particles passing through the deslime screen are directed toward the water based separation section of the coal preparation plant.

The clean coal and refuse screens receive the clean coal and refuse particles, respectively produced by the heavy media separating section. While on the clean coal and refuse screens, the clean coal and refuse particles are rinsed with water, and the finer particles and water passing through the respective screens are recirculated through the coal preparation plant. Rinsing the clean coal and refuse particles is primarily done to recover the particles of media, such as magnetite, remaining thereon as a result of the coal/refuse separation process, as magnetite can be quite expensive.

Traditionally, the majority of the media recovered by the clean coal and refuse screens is recovered as a slurry of media and water in the drain section of the underpan for each of the clean coal and refuse screens. This media is mixed with sized raw coal discharged from the deslime screen, piped to a pulping column and pumped from the pulping column to the heavy media separation section of the coal preparation plant.

The mixing of raw coal and media using conventional pulping columns requires the inclusion of the heavy media sump for the retention of media overflowing from the pulping column upon the addition of the raw coal feed. As raw coal is added to the pulping column, the displacement of media with raw coal increases the level in the pulping column forcing the displaced media into the heavy media sump. Conventional pulping columns may include an overflow which reports to a separate heavy media sump. The displaced media is then pumped back into the system. Alternately, conventional pulping columns may be integral to the heavy media sump to collect the overflow. These systems increase the overall size of the plant footprint, and add to the cost of building the coal preparation plant.

The present invention is directed toward overcoming one or more of the above-mentioned problems.

SUMMARY OF THE INVENTION

In a coal preparation plant which receives a raw coal feed and separates the raw coal feed into clean coal and refuse, an apparatus is provided for use therein. The inventive apparatus mixes the raw coal feed particles with a slurry of media and water used for separating the raw coal feed into the clean coal and refuse, without the requirement of an overflow for media storage. The inventive apparatus includes a pulping column with an inlet receiving both sized raw coal directly from a deslime screen, and a slurry of media and water directly from an drain portion of an underpan of at least one of a refuse screen and clean coal screen, and an outlet by which the mixture of sized raw coal and slurry exits the column. The pulping column mixes the sized raw coal and the slurry of media and water according to a select proportion, and it is then pumped to a heavy media separation section of the coal preparation plant.

In one form of the inventive apparatus, the pulping column is integrally formed with discharge chutework of the deslime screen, such that the sized raw coal from the deslime screen feeds directly into the pulping column. In a preferred form, the pulping column is also integrally formed with a drain section of the underpan of at least one of the refuse and clean coal screens, such that the slurry of media and water from the drain section feeds directly into the pulping column.

The pulping column may be either circular or rectangular in design, and is sized so that there is no overflow of media upon the addition of the raw coal feed and also to maintain the required pump section head for pumping the mixture to the heavy media separation section.

A nuclear density gauge may be provided for measuring the specific gravity of the mixture output by the pulping column. The nuclear density gauge is part of a control system that adjusts the addition of water to the output mixture to maintain the output mixture at a select specific gravity. Specifically, a water source is connected to the pulping column via at least one valve. The control valve adds water from the water source to the output mixture based upon the measured specific gravity value.

In another form, the inventive apparatus includes a pump for pumping the pulping column output mixture to a heavy media separating device. The pump has a suction connected to the pulping column output and an output connected to an input of the heavy media separating device. The water source is preferably connected between the pulping column output and the pump suction, while the nuclear density gauge is preferably provided between the pump output and the heavy media separating device input.

A method of mixing raw coal feed particles and a slurry of media and water is also provided. The method generally includes the steps of receiving at a pulping column, (a) sized raw coal directly from a deslime screen, and (b) a slurry of media and water directly from an underpan of at least one of a refuse screen and a clean coal screen, and mixing the raw coal and slurry in the pulping column according to a select proportion having a select specific gravity.

In one form, the inventive method further includes the steps of measuring the specific gravity of the sized raw coal and slurry mixture output of the pulping column, and adding water to the mixture in response to the measured specific gravity of the mixture to maintain the mixture at the select specific gravity.

A pump may be provided for pumping the sized raw coal and slurry mixture from the pulping column to a heavy media separating device. The pump is generally provided between the pulping column output and the heavy media separating device input. In a preferred form, the specific gravity of the sized raw coal and slurry mixture is measured downstream of the pump and upstream of the heavy media separating device. The water is preferably added to the sized raw coal and slurry mixture downstream of the pump and upstream of the pulping column output.

In another form of the inventive method, the pulping column is integrally formed with discharge chutework of the deslime screen, such that the sized raw coal from the deslime screen feeds directly into the pulping column.

In a further form of the inventive method, the pulping column is also integrally formed with a drain section of the underpan of at least one of the refuse and clean coal screens, such that the slurry of media and water from the drain section feeds directly into the pulping column.

It is an object of the present invention to:

- remove the need for a heavy media sump in coal preparation plants;
- provide an apparatus for mixing the raw coal particles and the slurry of media and water occupying minimal space in a coal preparation plant;
- provide a pulping column for mixing raw coal and a slurry of media and water while minimizing pipe work and equipment costs; and
- to eliminate the overflow normally associated with mixing sized raw coal and a slurry of media and water.

Other objects, aspects and advantageous of present invention can be obtained from a study of the specification, the drawings, and the appended claims.

DETAILED DESCRIPTION OF THE INVENTION

Figure 1:
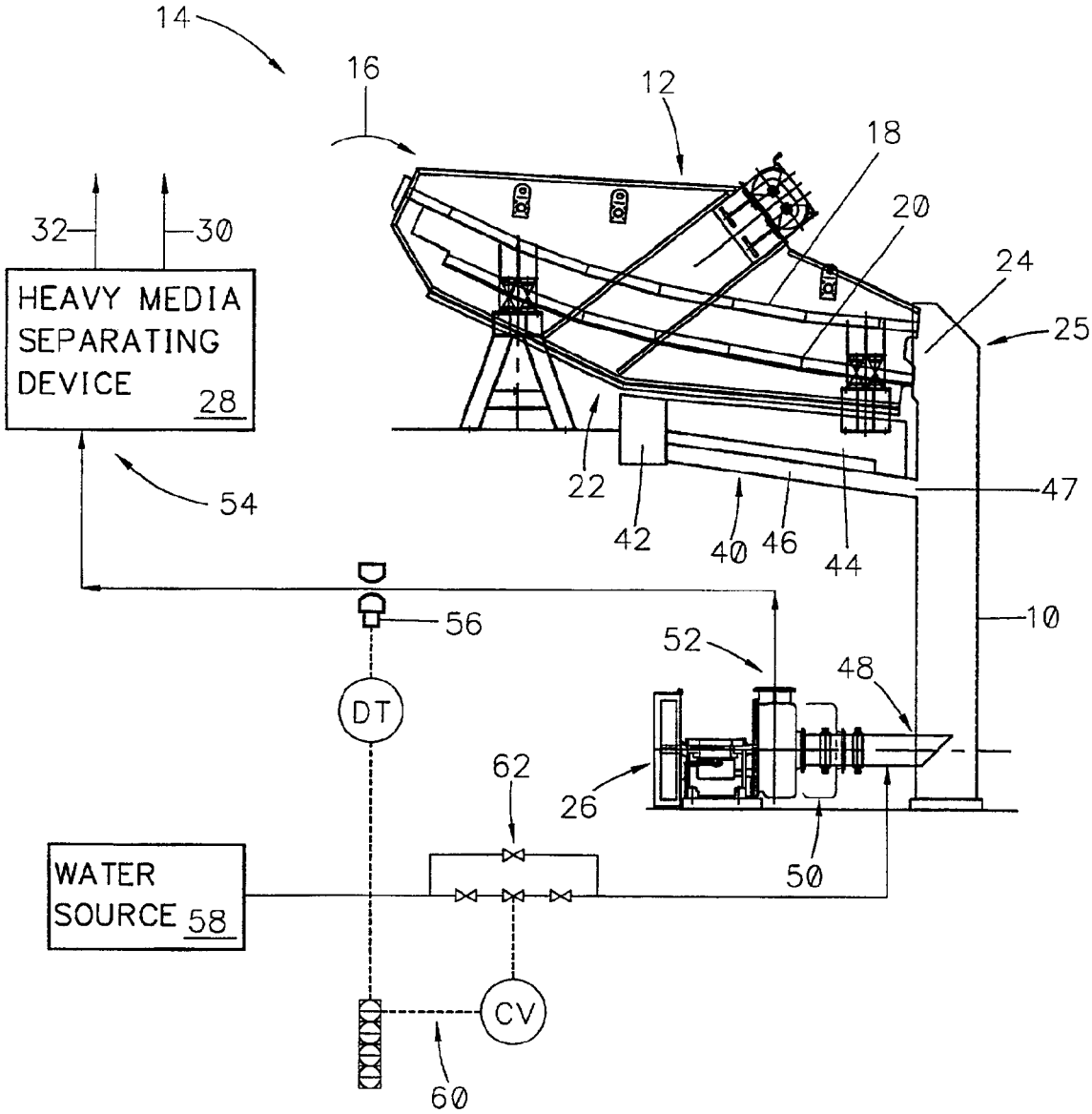
FIG. 1 is a side view of a pulping column according to the present invention in association with deslime, refuse and clean coal screens in a coal preparation plant.
Figure 2:
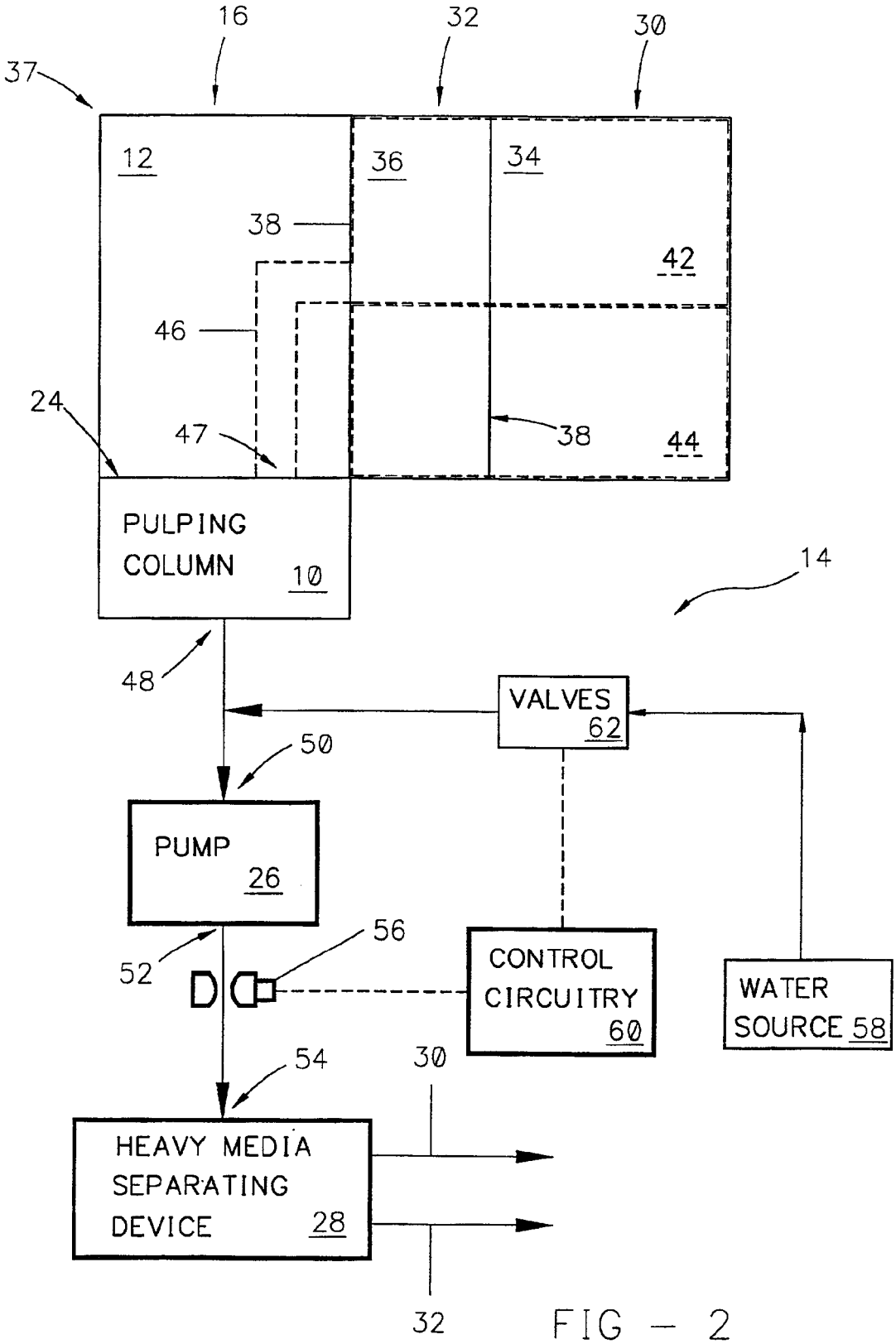
FIG. 2 is a combination top view and block diagram of the pulping column according to the present invention associated with deslime, refuse and clean coal screens in a coal preparation plant.

Referring to FIGS. 1 and 2, a pulping column according to the present invention is shown at 10 in association with a deslime screen 12 in a coal preparation plant, shown generally at 14. The deslime screen 12 receives a feed of raw coal 16 which is to be processed by the coal preparation plant 14. The deslime screen 12, with the addition of water, separates the raw coal 16 into coarse and fine sized fractions. The deslime screen 12 includes screens 18 and 20 which size the coarse or larger raw coal particles from the finer particles, with the finer particles and water passing to an underpan 22 of the deslime screen 12.

The raw coal particles 16 screened by the deslime screen 12 are received directly at a coal inlet 24 of the pulping column 10. The pulping column 10 is integrally formed with discharge chutework 25 of the deslime screen 12, such that the raw coal particles 16 from the deslime screen 12 feed directly to the pulping column 10. These raw coal particles 16 are mixed with a slurry of media and water in the pulping column 10, as will be hereinafter described, and fed, via a pump 26, to a conventional heavy media separating device 28 to produce clean coal 30 and refuse 32. Typically, these coal processing techniques will utilize a media, such as magnetite, and water to separate the clean coal particles 30 from the refuse particles 32 according to their specific gravities.

The clean coal particles 30 are fed to a clean coal screen 34 and, similarly, the refuse particles 32 are fed to a refuse screen 36. The clean coal particles 30 screened by the clean coal screen 34 are passed to a conventional clean coal handling section (not shown) of the coal preparation plant 14, while the refuse particles 32 screened by the refuse screen 36 are passed to a conventional refuse handling section (not shown) of the coal preparation plant 14.

Since magnetite is typically utilized as the media by heavy media separating device 28 for separating the clean coal 30 and refuse 32 particles, each will include particles of magnetite thereon. Since magnetite is generally expensive, rinsing the particles on the clean coal 34 and refuse 36 screens is done primarily to recover the magnetite particles adhering thereon for recirculation through and/or further processing by the coal preparation plant 14.

As shown more particularly in FIG. 2, the deslime 12, clean coal 34 and refuse 36 screens are formed as one screen assembly 37 with partition members 38 partitioning the screen assembly 37 into the various deslime 12, clean coal 34 and refuse 36 screens. The clean coal 34 and refuse 36 screens include an underpan, shown more particularly at 40 in FIG. 1, for receiving the recirculating media water used to rinse the coal and refuse particles of any magnetite adhering thereon, the washed-off magnetite, and any solid coal and refuse particles that have broken to be finer than the respective screen aperture openings. The underpan 40 is divided into a drain section 42 and a rinse section 44. The majority of the magnetite will be removed from the refuse and coal particles in the drain section 42. Magnetite that has not passed through the clean coal 34 or refuse 36 screens to the drain section 42 will be rinsed off of the respective clean coal/refuse particles and received in the rinse section 44.

Referring to FIGS. 1 and 2, the drain section 42 includes a conduit 46 connecting the drain section 42 to the pulping column 10, such that the drain section 42 can be considered as integrally formed with the pulping column 10. Thus, the slurry of media and water received in the drain section 42 will be directly received by the pulping column 10 at a media inlet 47, as shown more particularly in FIG. 1. For convenience, the chutework for the underpan 22 of the deslime screen 12 has been omitted in FIG. 1 to allow viewing of the underpan 40 associated with the clean coal 34 and refuse 36 screens.

The pulping column 10 mixes the raw coal particles 16 from the deslime screen 12 and the slurry of media and water from the drain section 42 of the underpan 40 according to a select proportion. Typically, the select proportion is four parts by volume of media and water to one part of coal. However, other volumetric proportions may be utilized without departing from the spirit and scope of the present invention.

Since the pulping column 10 is integrally formed with the chutework of both the deslime screen 12 and the drain sections 42 of the underpan 40, there is no overflow from the pulping column 10. As the pulping column 10 becomes filled, any excess mixture of coal and slurry will flow up the chute 46 to the drain section 42 of the underpan 40. The drain section 42 of the underpan 40 is accurately sized to meet the return media requirements of the system. The pulping column 10 is typically either circular or rectangular in cross-section, and has a column height sufficient to maintain the required pump suction head. Design of the inventive pulping column 10 in this manner eliminates the need for a heavy media sump for the retention of the media typically overflowing from the pulping column upon the addition of the raw coal feed particles, and also for the retention of the slurry of water and media from the clean coal and refuse screens. Thus, the overall size of the coal preparation plant area can be reduced.

The pulping column 10 includes an output 48 connected to a suction 50 of the pump 26. The pump 26 has a discharge output 52 connected to an input 54 of the heavy media separating device 28, and pumps the mixture of raw coal and slurry mixed in the pulping column 10 to the heavy media separating device 28 for separation into the clean coal 30 and refuse 32.

The specific gravity of the mixture of raw coal and slurry will depend upon the ratio of media to water in the mixture. To help maintain a select specific gravity of the mixture, which is required for the desired separation of coal from refuse in the heavy media separating device 28, a nuclear density gauge 56 is provided to measure the specific gravity of the mixture. The nuclear density gauge 56 helps maintain a select specific gravity of the mixture for proper separation by the addition of water to the mixture from a water source 58. The nuclear density gauge 56, via control circuitry 60, controls valves 62 which are connected to the water source 58 to add water to the mixture output by the pulping column 10 in accordance with the measured specific gravity valve. For example, if the specific gravity value measured by the nuclear density gauge 56 is too high, the valves 62 will open to allow the addition of water from the water source 58 to lower the specific gravity of the mixture. In a preferred form, the water from the water source 58 is added to the mixture at an area of the mixture flow downstream of the pulping column outlet 48 and upstream of the pump suction head 50. Also, in a preferred form, the nuclear density gauge 56 is positioned to measure the specific gravity of the mixture at an area of the mixture flow downstream of the pump outlet 52 and upstream of the heavy media separating device input 54.

Figure 3:
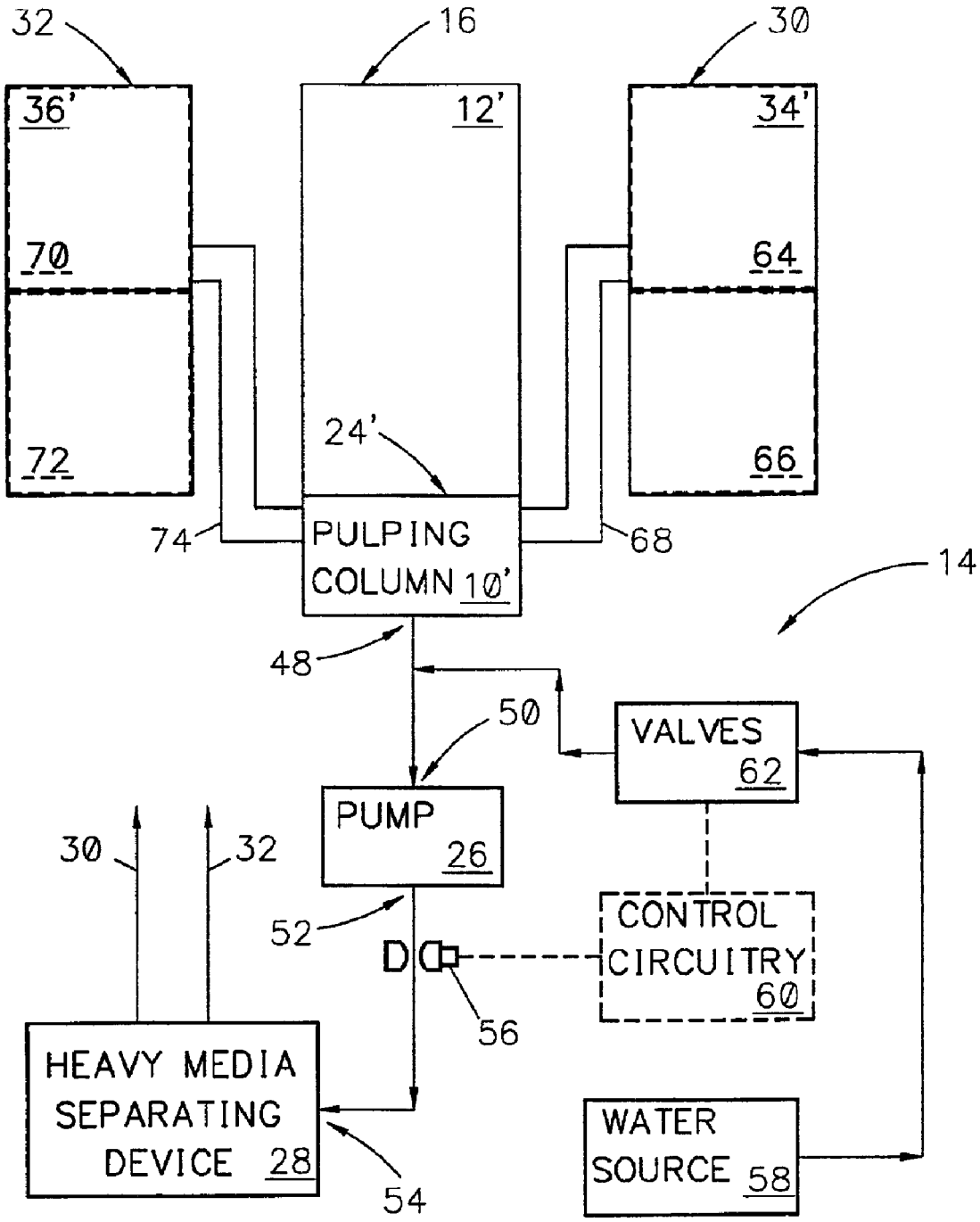
FIG. 3 is a combination top view and block diagram of a pulping column according to an additional embodiment of the present invention in association with deslime, refuse and clean coal screens in a coal preparation plant.

FIG. 3 illustrates an additional embodiment of the pulping column of the present invention, shown generally at 10', with like elements of FIGS. 1 and 2 indicated with the same reference number and elements requiring modification indicated with a prime (′). Basically, in the embodiment shown in FIG. 3, instead of the deslime 12, clean coal 34 and refuse 36 screens being formed as one screen assembly 37 as shown in FIG. 2, the deslime 12', clean coal 34' and refuse 36' screens are formed as three separate screen assemblies, as shown in FIG. 3. The deslime screen 12' receives the raw coal feed 16 and separates the raw coal feed 16 into coarse and fine sized fractions. The coarse raw coal particles 16 screened by the screens of the deslime screen 12' are received at the coal inlet 24' of the pulping column 10' and fed directly to the pulping column 10'. The clean coal 34' and refuse 36' screens receive the clean coal 30 and refuse 32 particles, respectively, and rinse and screen the respective particles in the same manner as previously described. However, as the screens 34' and 36' are formed from different screen assemblies, each includes its own underpan divided into respective drain and rinse sections.

The underpan of the clean coal screen 34' includes a drain section 64 and a rinse section 66. Most of the magnetite will be removed from the clean coal particles 30 in the drain section 64. Any magnetite that has not passed through the clean coal screen 34' to the drain section 64, the water used to rinse the solid coal particles of any magnetite adhering thereon, and any solid clean coal particles that have broken to be finer than the clean coal screen 34' aperture openings, will be received in the rinse section 66. The drain section 64 is appropriately sized and connected to the pulping column 10, via a conduit 68, such that the slurry of magnetite and water received in the drain section 64 is passed directly to the pulping column 10' for mixing with the raw coal particles 16 from the deslime screen 12'. In this manner, the drain section 64 can be considered as integrally formed with the pulping column 10'.

Similarly, the underpan of the refuse screen 36' is divided into a drain section 70 and a rinse section 72. Most of the magnetite will be removed from the refuse particles 32 in the drain section 70. Any magnetite that has not passed through the refuse screen 36' to the drain section 70, the water used to rinse the solid refuse particles of any magnetite adhering thereon, and any solid refuse particles that have broken to be finer than the refuse screen 36' aperture openings, will be received in the rinse section 72. The slurry of media and water collected in the drain section 70 of the refuse screen 36' is passed directly to the pulping column 10' via a conduit 74. In this manner, the pulping column 10' can be considered as integrally formed with the drain section 70. Again, there is no overflow of any materials from the pulping column 10'. As the pulping column 10' becomes filled, the water, magnetite and coal and refuse particles will simply flow up the conduits 68 and 74 and into the respective drain sections 64 and 70 of the clean coal 34' and refuse 36' screens.

The present invention provides a distinct advantage in that a heavy media sump is not required in the coal preparation plant 14, 14'. This aids in reducing the overall plant area. Further, since the pulping column 10, 10' does not include an overflow, no additional sumps are necessary to catch this overflow. The slurry of media and water and the sized raw coal particles are received directly by the pulping column 10, 10', where they are mixed and pumped to the heavy media separation device 28. While not specifically shown in the drawings, typically a portion of the slurry of media and water received in the drain sections of the clean coal and refuse screens are bled out of the slurry flow and passed to a dilute media sump (not shown) for further processing by the coal preparation plant 14, 14'.

While the present invention has been described with particular reference to the drawings, it should be understood that various modifications could be made without departing from the spirit and scope of the present invention. For instance, while the inventive integrally formed heavy media pulping column 10, 10' has been shown and described herein as used in a coal preparation plant 14, 14', the inventive integrally formed heavy media pulping column 10, 10' may be utilized in preparation plants for ore and minerals other than coal, using separation media other than magnetite, without departing from the spirit and scope of the present invention.

We claim:

1. In a mineral preparation plant receiving a raw mineral feed and separating the raw mineral feed into clean mineral and refuse, an apparatus for mixing the raw mineral feed particles with a slurry of media and water, said apparatus comprising:

a pulping column having a mineral inlet receiving sized raw mineral directly from a deslime screen, a media inlet receiving a slurry of media and water directly from an underpan of at least one of a refuse screen and a clean mineral screen, and an outlet outputting a mixture of the sized raw mineral and slurry, wherein the pulping column mixes the sized raw mineral and the slurry of media and water according to a select proportion having a select specific gravity.

2. The apparatus of claim 1, wherein the mineral comprises coal, and wherein the media comprises magnetite.

3. The apparatus of claim 1, wherein the pulping column is integrally formed with discharge chute work of the deslime screen, such that the sized raw mineral from the deslime screen feeds directly to the pulping column.

4. The apparatus of claim 1, wherein the pulping column is integrally formed with a drain section of the underpan of at least one refuse screen and the clean mineral screen, such that the slurry of media and water from the drain section feeds directly to the pulping column.

5. The apparatus of claim 1, wherein the pulping column is integrally formed with both discharge chutework of the deslime screen and a drain section of the underpan of at least one of the refuse screen and the clean mineral screen, such that the sized raw mineral from the deslime screen and the slurry of media and water from the drain section feeds directly to the pulping column for mixing.

6. The apparatus of claim 1, further comprising a nuclear density gauge measuring the specific gravity of the mixture output by the pulping column and a control system, the control system configured to add water to the output mixture to maintain the output mixture at the select specific gravity measured by the nuclear density gauge.

7. The apparatus of claim 6, wherein the control system comprises a water source connected to the pulping column output via at least one valve, wherein the control system adjusts the at least one valve to add water from the water source to the output mixture based upon the measured specific gravity value as measured by the nuclear density gauge.

8. The apparatus of claim 7, further comprising a pump for pumping the pulping column output mixture to a heavy media separating device, the pump having a suction connected to the pulping column output and an output connected to an input of the heavy media separating device, wherein the water source is connected between the pulping column output and the pump suction, and wherein the nuclear density gauge is provided between the pump output and the heavy media separating device input.

9. The apparatus of claim 1, wherein the pulping column is sized such that no overflow of the sized raw mineral and slurry mixture occurs.

10. A method of mixing raw mineral feed particles and a slurry of media and water, said method comprising the steps of:

receiving at a pulping column sized raw mineral directly from a deslime screen;

receiving at the pulping column a slurry of media and water directly from an underpan of at least one of a refuse screen and a clean mineral screen; and mixing the sized raw mineral and slurry in the pulping column according to a select proportion having a select specific gravity.

11. The method of claim 10, further comprising the steps of:

measuring the specific gravity of the slurry mixture containing the raw sized mineral; and adding water to the mixture in response to the measured specific gravity of the mixture to maintain the mixture at the select specific gravity.

12. The method of claim 11, further comprising the step of:

providing a pump for pumping the sized raw mineral and slurry mixture from the pulping column to a heavy media separating device, the pump provided between the pulping column output and the heavy media separating device input.

13. The method of claim 12, wherein the measuring step comprises the step of measuring the specific gravity of the slurry containing the sized raw mineral and media downstream of the pump and upstream of the heavy media separating device; and the adding step comprises the step of adding water to the sized raw mineral and slurry mixture upstream of the pump and downstream of the pulping column output.

14. The method of claim 10, where the mineral comprises coal, and wherein the media comprises magnetite and/or ferrosilicon.

15. The method of claim 10, wherein the pulping column is integrally formed with discharge chutework of the deslime screen, such that the sized raw mineral from the deslime screen feeds directly to the pulping column.

16. The method of claim 10, wherein the pulping column is integrally formed with a drain section of the underpan of at least one of the refuse screen and the clean mineral screen, such that the slurry of media and water from the drain section is fed directly to the pulping column.

17. The method of claim 10, wherein the pulping column is integrally formed with both discharge chutework of the deslime screen and a drain section of the underpan of at least one of the refuse screen and the clean mineral screen, such that the sized raw mineral from the deslime screen and the slurry of media and water from the drain section is fed directly to the pulping column for mixing.

18. A method of mixing raw mineral feed particles and a slurry of media and water, said method comprising the steps of:

providing a pulping column integrally formed with discharge chutework of a deslime screen, such that the sized raw mineral from the deslime screen is received directly into the pulping column;

receiving at the pulping column a slurry of media and water directly from an underpan of at least one of a refuse screen and a clean mineral screen;

mixing the sized raw mineral and slurry in the pulping column according to a select proportion; and maintaining the slurry of media and water in the mixture of sized raw mineral and slurry at a select specific gravity.

19. The method of claim 18, wherein the maintaining step comprises the steps of:

measuring the specific gravity of the slurry containing media, water and sized raw mineral; and selectively adding water to the mixture in response to the measured specific gravity of the slurry to maintain the slurry at the select specific gravity.

20. The method of claim 18, wherein the pulping column is additionally integrally formed with a drain section of the underpan of at least one of the refuse screen and the clean mineral screen, such that the slurry of media and water from the drain section is received directly into the pulping column.

* * * * *